United States Patent [19]

Persaud

[11] Patent Number: 4,984,568

[45] Date of Patent: Jan. 15, 1991

[54] BACK MASSAGING DEVICE

[76] Inventor: Harvey Persaud, 14508 Stonebridge View Dr., Gaithersburg, Md. 20878

[21] Appl. No.: 420,477

[22] Filed: Oct. 12, 1989

[51] Int. Cl.[5] ..... A61H 15/00; A61H 23/00

[52] U.S. Cl. ..... 128/51; 128/57; 128/55

[58] Field of Search ..... 128/57, 55, 53, 52, 128/51; 901/14, 17

[56] References Cited

U.S. PATENT DOCUMENTS

| | | | |
|---|---|---|---|
| 3,078,843 | 2/1963 | Brisson | 128/52 |
| 3,471,888 | 10/1969 | Grant et al. | 901/14 |
| 3,951,271 | 4/1976 | Mette | 901/17 |
| 4,041,938 | 8/1977 | Wintoniw | 128/52 |
| 4,190,043 | 2/1980 | Thompson | 128/57 |
| 4,411,421 | 10/1983 | Hershberger | 128/57 |
| 4,513,738 | 4/1985 | Niessen | 128/57 |
| 4,656,998 | 4/1987 | Masuda et al. | 128/57 |
| 4,721,100 | 1/1988 | Hengl | 128/57 |
| 4,875,470 | 10/1989 | Cotone | 128/57 |

FOREIGN PATENT DOCUMENTS

| | | | |
|---|---|---|---|
| 666180 | 7/1988 | Switzerland | 128/52 |
| 2166351 | 5/1986 | United Kingdom | 128/57 |

*Primary Examiner*—Edgar S. Burr
*Assistant Examiner*—Ren Yan
*Attorney, Agent, or Firm*—Jerry T. Kearns

[57] ABSTRACT

A back massaging device includes a base having a clamp for securement to a bed frame rail. A vertical column is mounted for reciprocal axial and rotational movement on the base. A transverse arm is pivotally mounted at an upper end of the vertical column and includes an actuating rod mounted for reciprocal parallel linear movement therewith. A massaging implement is pivotally secured on a distal end of the actuating rod. A programmable control simultaneously controls movement of the vertical column, the transverse arm and the actuating rod to move the massaging implement over a preprogrammed contour of an individual's back. The programmable control may include a remotely operable joystick to allow control of the back massaging device by a reclining individual during a back massaging operation. The massaging implement may include a remotely actuatable lotion dispenser.

3 Claims, 5 Drawing Sheets

BACK MASSAGING DEVICE

BACKGROUND OF THE INVENTION

1. Field of the Invention

The present invention relates to massaging devices, and more particularly pertains to an improved automatic back massaging device. Many people today, in our fast-paced, hectic environment, can never find the time to relax and unwind. For those who can find the time to relax, an activity that can soothe the tension and exhausted muscles provides a great deal of stress release. A massage activity providing this stress release has been conventionally afforded by human masseurs. However, a conventional massage can be expensive, and requires prearranged appointments and is thus not conveniently available in a home environment. Rudimentary massaging devices proposed by the prior art include a vibrating bed frame and various manually manipulated devices. These conventional massage implements are relatively expensive and cumbersome to use, while at the same time not affording a thorough massage. The present invention seeks to overcome these prior art disadvantages by providing a remotely controlled programmable robotic type massaging device.

2. Description of the Prior Art

Various types of massaging devices are known in the prior art. A typical example of such a massaging device is to be found in U.S. Pat. No. 4,190,043, which issued to T. Thompson on Feb. 26, 1980. This patent discloses a massage table including a drive system for rotating a driven massage roller while reciprocating the table top. U.S. Pat. No. 4,411,421, which issued to V. Hershberger on Oct. 25, 1983, discloses a therapeutic manually actuated massaging device. Manual manipulation of pivotal handles causes the massage rollers to traverse an individual's back. U.S. Pat. No. 4,513,738, which issued to C. Niessen on Apr. 30, 1985, discloses a massage unit having a stationary frame which serves as a carrier for a motor driven drum upon which are journalled freely rotatable massage rollers. The device includes a bench or bed which is slidable transversely to the axis of the drum for moving an individual into contact with the massage drum. U.S. Pat. No. 4,656,998, which issued to T. Masuda et al on Apr. 14, 1987, discloses a massage table including a foldable base plate having carriers with massage rollers thereon. The massage rollers are mounted for movement along a linear guide track by a belt drive mechanism. U.S. Pat. No. 4,721,100, which issued to G. Hengl on Jan. 26, 1988, discloses a massaging machine having a cantilevered horizontally slidable massage brush. The brush is slidable along the horizontal frame and a counter weight is automatically slidable in the opposite direction as the brush, to maintain a constant pressure of the brush on the back of an individual.

While the above mentioned devices are directed to massaging devices, none of these devices disclose a programmable massaging device including a massaging implement movable along a preprogrammed contour of an individual's back. Additionally, none of the aforesaid devices include an automatic remotely actuatable lotion dispenser in conjunction with a programmable massaging implement. Inasmuch as the art is relatively crowded with respect to these various types of massaging devices, it can be appreciated that there is a continuing need for and interest in improvements to such massaging devices, and in this respect, the present invention addresses this need and interest.

SUMMARY OF THE INVENTION

In view of the foregoing disadvantages inherent in the known types of massaging devices now present in the prior art, the present invention provides an improved back massaging device. As such, the general purpose of the present invention, which will be described subsequently in greater detail, is to provide a new and improved back massaging device which has all the advantages of the prior art massaging devices and none of the disadvantages.

To attain this, a representative embodiment of the concepts of the present invention is illustrated in the drawings and makes use of a back massaging device which includes a base having a clamp for securement to a bed frame rail. A vertical column is mounted for reciprocal axial and rotational movement on the base. A transverse arm is pivotally mounted at an upper end of the vertical column and includes an actuating rod mounted for reciprocal parallel linear movement therewith. A massaging implement is pivotally secured on a distal end of the actuating rod. A programmable control simultaneously controls movement of the vertical column, the transverse arm and the actuating rod to move the massaging implement over a preprogrammed contour of an individual's back. The programmable control may include a remotely operable joystick to allow control of the back massaging device by a reclining individual during a back massaging operation. The massaging implement may include a remotely actuatable lotion dispenser.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved back massaging device which has all the advantages of the prior art massaging devices and none of the disadvantages.

It is another object of the present invention to provide a new and improved back massaging device which may be easily and efficiently manufactured and marketed.

It is a further object of the present invention to provide a new and improved back massaging device which is of a durable and reliable construction.

An even further object of the present invention is to provide a new and improved back massaging device which is susceptible of a low cost of manufacture with regard to both materials and labor, and which accordingly is then susceptible of low prices of sale to the consuming public, thereby making such massaging devices economically available to the buying public.

Still yet another object of the present invention is to provide a new and improved back massaging device which provides in the apparatuses and methods of the prior art some of the advantages thereof, while simultaneously overcoming some of the disadvantages normally associated therewith.

Still another object of the present invention is to provide a new and improved back massaging device including a massaging implement operative to follow a preprogrammed contour of an individual's back.

Yet another object of the present invention is to provide a new and improved back massaging device which is attachable to a conventional bed frame railing.

Even still another object of the present invention is to provide a new and improved back massaging device including a remotely actuatable automatic lotion dispenser.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
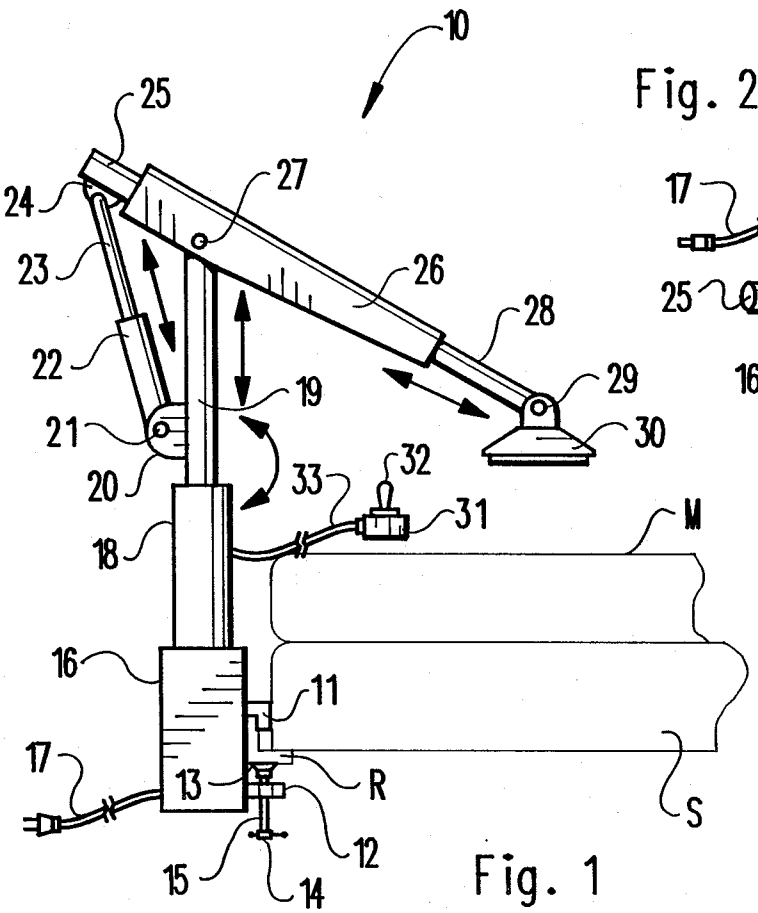
FIG. 1 is a side elevational view illustrating the back massaging device according to the present invention.

With reference now to the drawings, and in particular to FIG. 1 thereof, a new and improved back massaging device embodying the principles and concepts of the present invention and generally designated by the reference numeral 10 will be described.

More specifically, it will be noted that the first embodiment 10 of the invention includes a base unit 16. Spaced clamping arms 11 and 12 are secured to a back exterior wall of the base 16. A pivotal foot member 13 is mounted by a ball and socket mechanism on a distal end of a threaded rod 15. The threaded rod 15 extends in threaded engagement through the clamping arm 12. Rotation of a handle end portion 14 of the rod 15 causes the foot member 13 to move into clamping engagement with a horizontal frame railing R of a conventional bed. The bed includes a conventional box spring S and an upper mattress M. A power cord 17 extends from the base unit 16 for connection with a conventional AC outlet. A vertical column 19 is mounted for reciprocal linear axial movement within an upstanding well 18 extending vertically through an upper surface of the base 16. The vertical column 19 is also mounted for reciprocal rotation. A pivot mounting tab 20 is secured for movement with the column 19 and includes a pivot pin 21 mounted to a hydraulic cylinder 22. The piston rod 23 of the hydraulic cylinder 22 is pivotally secured to a mounting tab 24 provided on a rear end portion 25 of a transverse arm 26. The transverse arm 26 is secured by a pivotal mounting pin 27 at an upper end of the column 19. As may now be understood, actuation of the hydraulic cylinder 22 causes pivotal movement of the transverse arm 26 about the horizontal axis of the pivot pin 27. An actuating rod 28 is mounted for reciprocal linear movement parallel with the transverse arm 26, in a telescopic fashion. Linear movement of the actuating rod 28 may be likewise effected by a double acting hydraulic cylinder arrangement. A massaging implement 30 is secured by a pivot pin 29 to a distal end portion of the actuating rod 28. The linear and rotary movement of the vertical column 19, as well as the pivotal movement of the transverse arm 26 and the linear extension and retraction of the actuating rod 28, are controlled by a programmed control mechanism. A remote control unit 31 includes a joystick type control lever 32 connected by an interface cord 33 with the programmed control unit located within the base 16. While the various linear actuators have been described with respect to the preferred hydraulic embodiment, it is contemplated that other linear actuators, such as stepping motors in conjunction with ball lead screws, may be employed without departing from the scope of the present invention. It should be noted that the particular programmed hydraulic control may be of the type employed in conventional industrial robots, without departing from the scope of the present invention. In this context, it is deemed that those of skill in the robotic art are well acquainted with the control mechanisms described, and as such no further descriptions will be hereinafter provided.

Figure 2:
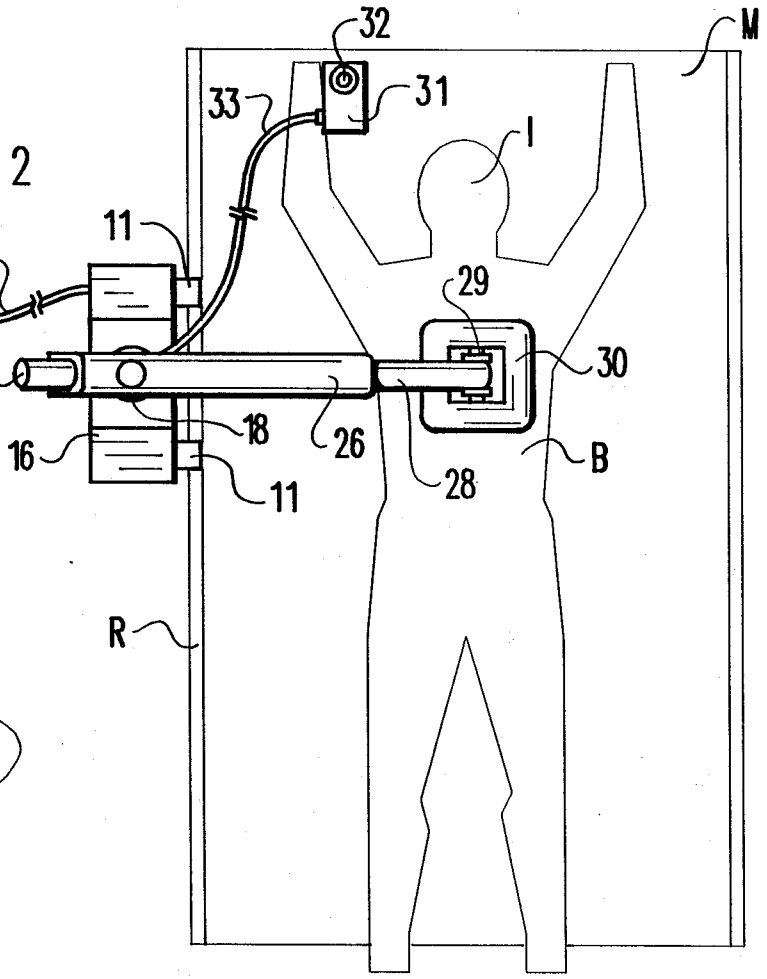
FIG. 2 is a top plan view, further illustrating the manner of use of the back massaging device of the present invention.

FIG. 2 is a top plan view which illustrates an individual I lying on the mattress M. The massaging implement 30 is movable along the contour of the individual's back B by selective simultaneous actuation of the previously described rotary and linear actuators by a conventional form of programmable control mechanism. It should be noted that through manipulation of the remote control unit 31, the individual I may effect manual control of the massaging implement 30, without leaving the illustrated reclining position.

Figure 3:
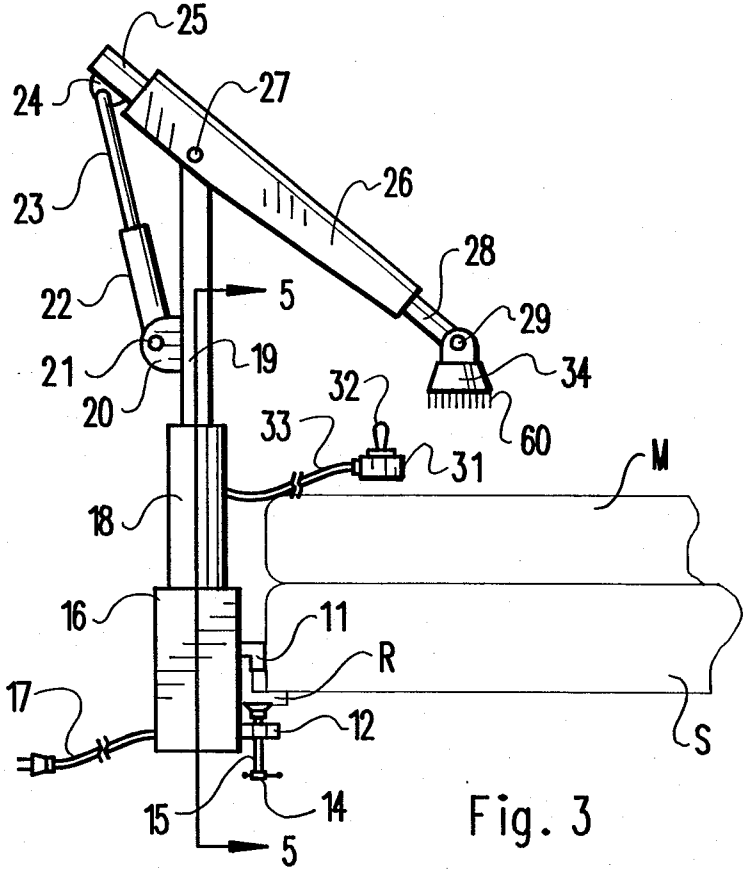
FIG. 3 is a side elevational view, illustrating the back massaging device utilizing a slightly modified massaging implement.

FIG. 3 is a side elevational view illustrating the massaging device of the present invention provided with a modified form of massaging implement 34. The massaging implement 34 may include a plurality of resilient fingers 60 to provide a massage effect.

Figure 4:
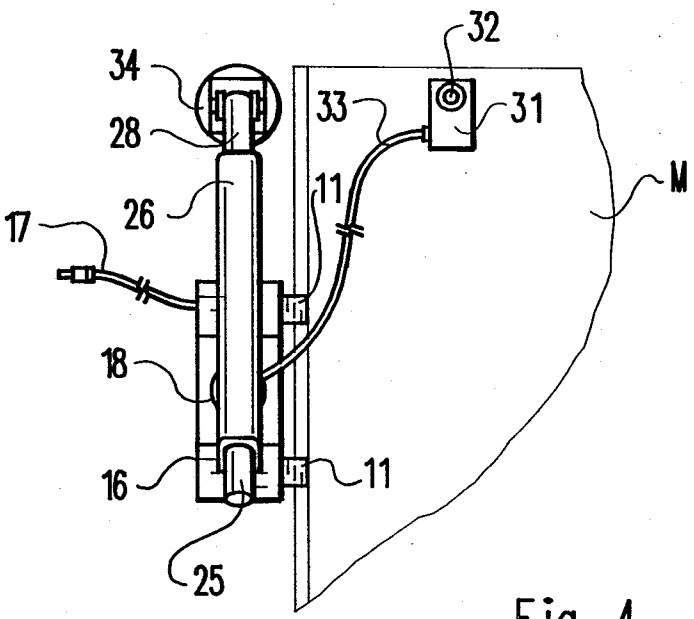
FIG. 4 is a top plan view of the massaging device of FIG. 3, with the massaging implement control linkage in a parked position.

As shown in FIG. 4, the transverse arm 26 may be disposed in a "park" position, when not in use. This allows the mattress M to be utilized in a conventional manner, without detaching the massaging device of the present invention.

Figure 5:
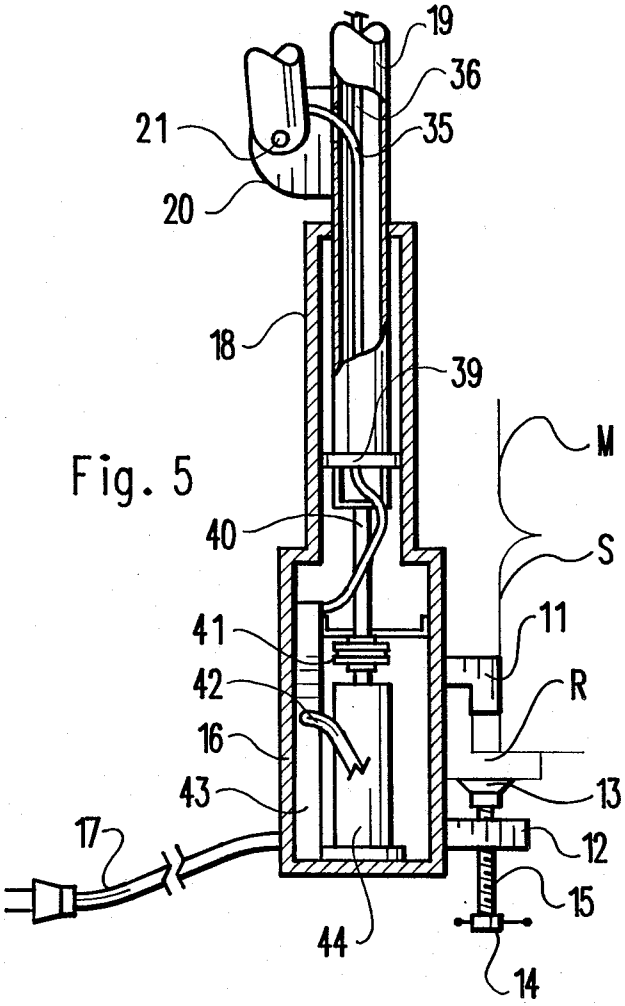
FIG. 5 is a cross sectional detail view, taken along line 5—5 of FIG. 3.

FIG. 5 is a longitudinal cross sectional detail view, taken along line 5—5 of FIG. 3, which illustrates the vertical column 19 mounted within the well 18. An enlarged radial flange 39 serves as a stabilizing bearing which engages the interior side walls of the well 18. An actuating rod 40 of a hydraulic cylinder 44 is connected to the vertical column 19, and serves to effect linear and rotational movement thereof. The rod 40 is rotationally mounted within the cylinder 44 and includes a spline pulley 41. The control mechanism 43 within the interior of the base 16 includes a conventional hydraulic supply system including the required hydraulic pump and accumulators. The construction of the required numeric control apparatus, hydraulic system, and associated electro mechanical valves are readily apparent to those of skill in the fabrication of industrial robots, to whom the present specification is directed. A hydraulic supply line 42 from the control system 43 is connected to the double acting hydraulic cylinder 44. Additional hydraulic lines 35 and 36 extend through the hollow interior of the vertical column 19.

Figure 6:
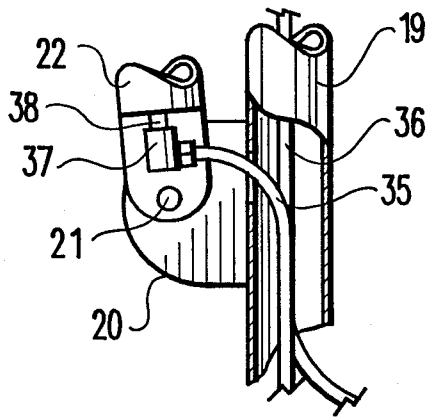
FIG. 6 is a cross sectional detail view, illustrating hydraulic line connections.

FIG. 6 illustrates the hydraulic supply line 35 which is connected by a coupling 37 to a hydraulic line 38 which supplies the cylinder 22 with pressure as required. The hydraulic line 36 extends upwardly through the column 19 to effect control of the actuating rod 28 (FIG. 3) mounted within the transverse arm 26.

Figure 7:
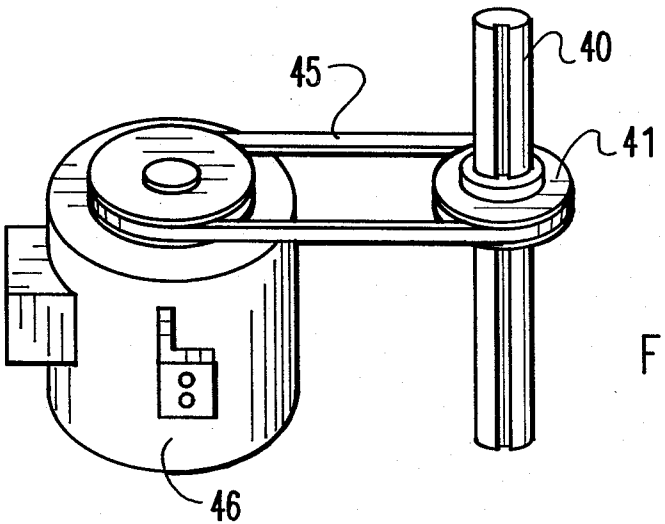
FIG. 7 is a perspective detail view illustrating the vertically movable column rotating drive mechanism.

FIG. 7 illustrates the details of the mechanism for selectively rotating the vertical column 19. The rotatably mounted and axially movable piston rod 40 is splined to effect a non-rotatable connection with a pulley 41. The pulley 41 is driven by a belt 45 connected to an electric motor 46. The electric motor 46 is preferably a numerically controlled stepping motor to allow rotation of the shaft 40 in discreet angular increments, in either of the two opposite rotational directions. The control and construction of stepping motors is of course readily apparent to those of ordinary skill in the art.

Figure 8:
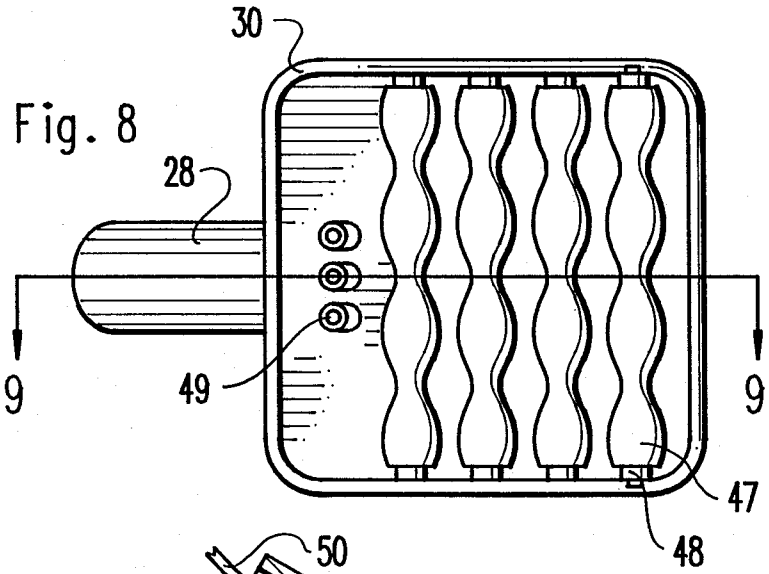
FIG. 8 is a bottom plan view illustrating the massaging implement according to a first embodiment.

FIG. 8 is a bottom plan view illustrating the massaging implement 30, according to a first contemplated alternative. A plurality of contoured rollers 47 are mounted by axles 48 to the generally rectangular massaging base 30 by a plurality of axles 48. A plurality of nozzles 49 extend downwardly from the massaging implement base 30, for dispensing lotion from an interior reservoir.

Figure 9:
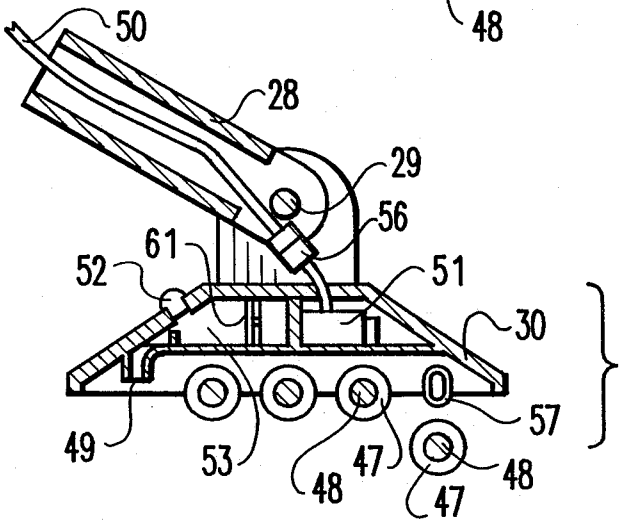
FIG. 9 is a cross sectional view, taken along line 9—9 of FIG. 8.

As shown in the cross sectional view of FIG. 9, a hydraulic line 50 extends through the interior of the actuating rod 28, and is secured to a quick release connector 56. The quick release connector 56 allows the massaging implement 30 to be rapidly changed. A small hydraulic cylinder 51 is mounted within the interior of the massaging implement 30, and includes an actuating plunger 61 movable within a lotion reservoir 53. A combination sight glass and fill opening cover 52 allows the reservoir 53 to be filled with a selected lotion or massage oil, and also allows visual monitoring of the remaining quantity within the reservoir 53. The dispensing nozzles 49 are in fluid communication with the reservoir 53, such that actuation of the plunger 61 causes the dispensing of the selected fluid through the nozzles 49 and onto the back of a user. As shown, the rollers 47 are removably installed within resilient sockets 57 provided on the lower peripheral portion of the massaging implement 30. This allows the massaging rollers 47 to be conveniently changed to provide various different contours, and compositions.

Figure 10:
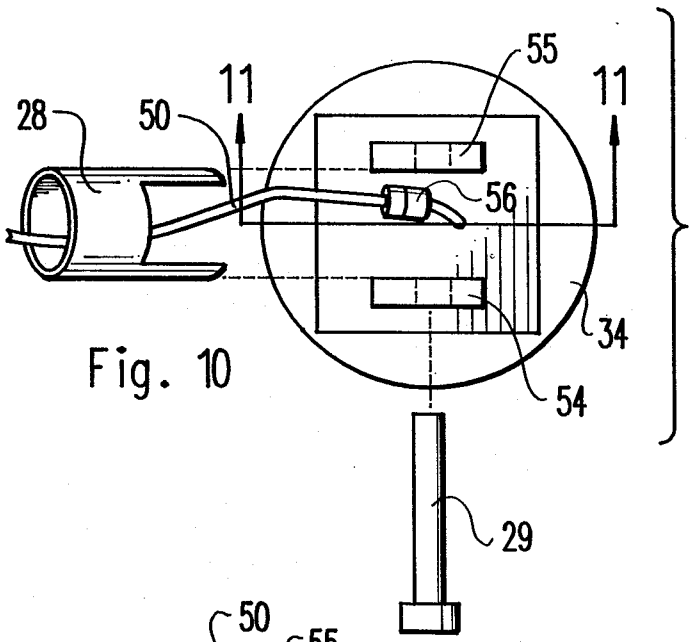
FIG. 10 is an exploded view illustrating a modified massaging implement according to a second embodiment of the present invention.

FIG. 10 is an exploded view illustrating a massaging implement 34 according to a slightly modified embodiment. The implement 34 includes a pair of spaced yoke members 54 and 55 which provide a pivotal connection with the distal end portion of the actuating rod 28. A pivot pin 29 extends transversely through the yoke members 54 and 55, and through the actuating rod 28. Thus, the massaging implement 34 is mounted for free pivotal movement, which allows close conformance with the contours of an individual's back. It should be noted that the same mechanism may be employed for mounting the massaging implement 30 illustrated in FIG. 9.

Figure 11:
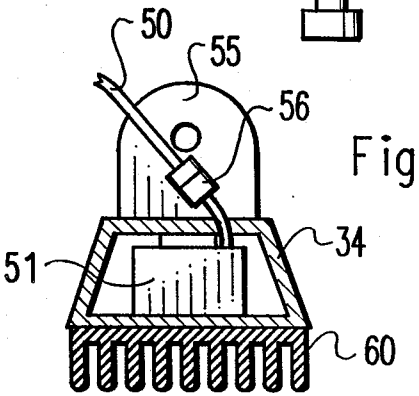
FIG. 11 is a cross sectional view, taken along line 11—11 of FIG. 10.

As shown in the cross sectional view of FIG. 11, the massaging implement 34 may include a hydraulic actuator 51 for dispensing lotion therefrom, in the manner described previously with reference to FIG. 9. The massaging implement 34 includes a plurality of resilient fingers 60, preferably formed from a rubber material to provide a realistic massaging effect.

Figure 12:
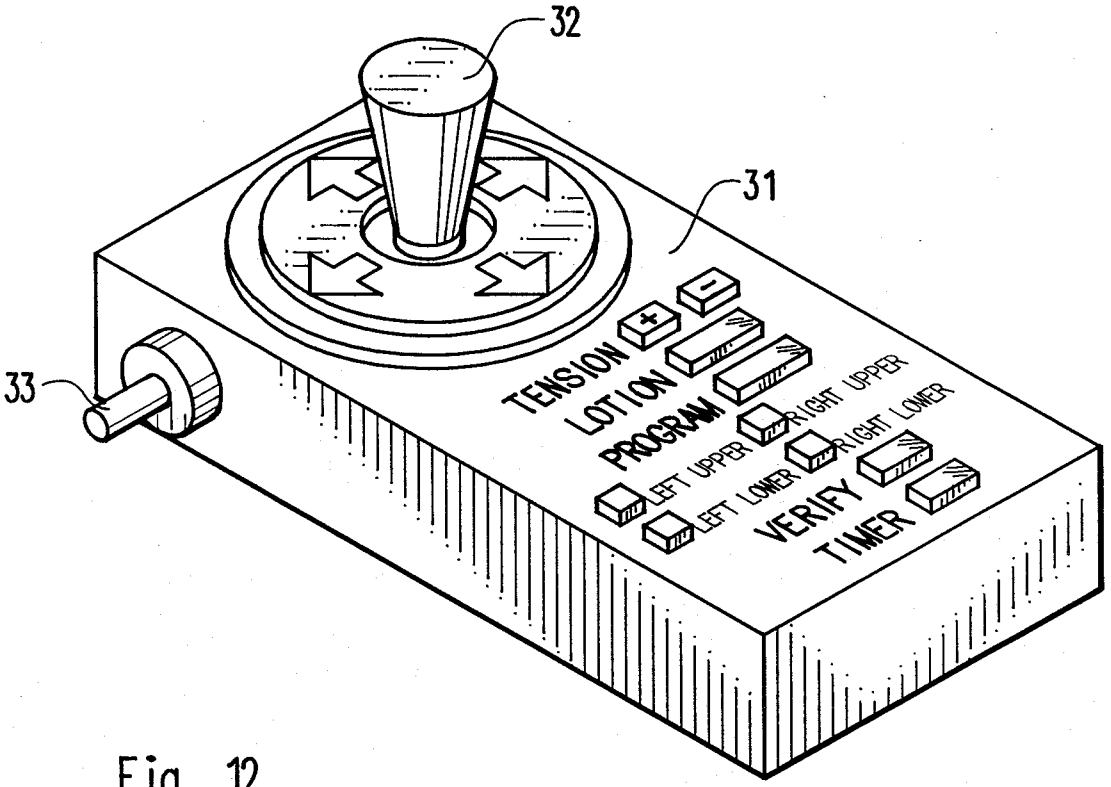
FIG. 12 is a perspective view illustrating a remote control unit of the massaging device of the present invention.

FIG. 12 is a perspective view which illustrates the remote control unit 31. It is contemplated that the control system employed may be of the type utilized with numerically controlled programmable industrial robots, of the type utilized for pick and place operations, and also for effecting a programmed contour surface finish during metal removal operations, for example through the use of a rotary grinding tool. This conventional form of robotic control utilizes a joystick 32, which is manipulated by an operator, during a program or teaching mode, to define the limits of the surface to be traversed by the massaging implement. To this end, an individual depresses the "PROGRAM" switch of the control unit 31, and then manually manipulates the joystick type control lever 32 to cause the massaging implement to traverse the limits of their back. When a selected corner of their back has been reached by the massaging implement, the individual depresses the appropriated button, for example "LEFT UPPER", to set the three orthogonal dimensional perimeters into the control memory. The individual continues in this manner, until the corner limit contours of their back have been established in the program control memory. The individual then begins the massaging operation by setting the timer to the desired time level. During the massaging operation, the "TENSION" controls may be manually manipulated to increase or decrease the vertical elevational position of the massage implement at a particular location on their back. By fine tuning the vertical position in this manner, the individual may regulate the massaging force applied to their personal preference. During the massaging operation, an individual may selectively apply a predetermined quantity of lotion by depressing the "LOTION" button on the remote control unit 31.

As may now be understood, the present invention provides a robotic type massaging implement, which utilizes a programmable numerical control to provide a thorough and relaxing massage. It should be noted that the device is preferably constructed of lightweight alloy materials to allow convenient transportability. The device is particularly useful to provide physical therapy to hospital patients and homebound individuals.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A back massaging device, comprising:

a base;

clamp means for securing said base to a bed frame rail;

a vertical column mounted on said base for reciprocal axial movement and reciprocal rotational movement about a longitudinal axis of said vertical column;

means for axially moving said vertical column;

means for rotating said vertical column;

a transverse arm pivotally mounted at an upper end of said vertical column;

a hydraulic piston and cylinder assembly having a first end pivotally connected to said vertical column and a second end pivotally connected to said transverse arm for pivoting said transverse arm about a horizontal axis;

an actuating rod mounted for reciprocal linear movement parallel with said transverse arm;

means for linearly moving said actuating rod;

a massaging implement pivotally secured on a distal end of said actuating rod;

said transverse arm being pivotally mounted to said vertical column at a point disposed between said massaging implement and said hydraulic piston and cylinder assembly;

a remotely actuated lotion dispenser in said massaging implement; and programmed control means for moving said vertical column, said transverse arm and said actuating rod to move said massaging implement over programmed contours of an individual's back.

2. The back massaging device of claim 1, wherein said massaging implement includes a plurality of rollers.

3. The back massaging device of claim 1, wherein said massaging implement includes a plurality of resilient fingers.

* * * * *